US008793894B2

(12) United States Patent
Bo

(10) Patent No.: US 8,793,894 B2
(45) Date of Patent: Aug. 5, 2014

(54) CLOTHES DRYING CABINET

(76) Inventor: Hu Jie Bo, Ci Xi (CN)

( * ) Notice: Subject to any disclaimer, the term of this patent is extended or adjusted under 35 U.S.C. 154(b) by 1166 days.

(21) Appl. No.: 12/309,989

(22) PCT Filed: Sep. 30, 2007

(86) PCT No.: PCT/CN2007/002881

§ 371 (c)(1),
(2), (4) Date: Feb. 4, 2009

(87) PCT Pub. No.: WO2008/022572

PCT Pub. Date: Feb. 28, 2008

(65) Prior Publication Data

US 2009/0235555 A1 Sep. 24, 2009

(51) Int. Cl.
*F26B 19/00* (2006.01)

(52) U.S. Cl.
USPC ..... 34/201

(58) Field of Classification Search
USPC ..... 34/85, 130, 389, 499, 260, 264, 265, 34/451, 201
See application file for complete search history.

(56) References Cited

U.S. PATENT DOCUMENTS 3,432,939 A * 3/1969 Eichholz ..... 34/622
4,199,873 A * 4/1980 Hansen et al. ..... 34/202
4,876,436 A * 10/1989 Ide et al. ..... 392/360
5,131,547 A * 7/1992 Goldberg ..... 211/149
5,546,678 A * 8/1996 Dhaemers ..... 34/275
5,755,040 A * 5/1998 Ou ..... 34/202
5,873,179 A * 2/1999 Gregory et al. ..... 34/90
6,185,838 B1 * 2/2001 Moore ..... 34/202
6,889,449 B2 * 5/2005 Silver ..... 34/490
7,191,546 B2 * 3/2007 Maruca ..... 34/201
7,802,582 B2 * 9/2010 Livacich et al. ..... 135/147
2004/0163184 A1 * 8/2004 Waldron et al. ..... 8/149.1

FOREIGN PATENT DOCUMENTS

CN 2656466 A1 * 11/2004

* cited by examiner

*Primary Examiner* — Kenneth Rinehart
*Assistant Examiner* — John McCormack
(74) *Attorney, Agent, or Firm* — Raymond Y. Chan; David and Raymond Patent Firm

(57) ABSTRACT

A clothes drying cabinet which consists of a base, a frame, a cover and a control unit is disclosed. A heat source, a warm air cushion chamber and a clothes drying chamber are provided inside the clothes drying cabinet. The heat source comprises a fan motor and a PCT heating element. The frame is positioned on the base and supported by the hanger braces. The division plate for the warm air cushioning chamber forms the warm air cushioning chamber with the protection plate of the warm air channel in the lower parts and forms the cloth drying chamber. The frame is covered outside by the cover. The control unit comprises a control panel and switches. The clothes drying effect can be improved and the drying speed can be increased, furthermore the clothes drying cabinet is safe so that the danger due to clothes falling down can be prevented.

6 Claims, 3 Drawing Sheets

CLOTHES DRYING CABINET

BACKGROUND OF THE PRESENT INVENTION

1. Field of Invention

The present invention relates to a cloth drying appliance, and more particularly to a cabinet type clothes drying appliance.

2. Description of Related Arts

Nowadays, due to the limitation of weather and location, more and more people have to use the drum-type dryer or the washing machines with dryer function, which are found in every appliance store. Even though the intelligence design and safety standards of the both types of conventional dryer product meet the national requirements, there are still drawbacks as follows. The drum-type dryer easily causes wrinkles and damages to the clothes during the rotation operation that needs time to be ironing thereafter. Moreover, the design of the conventional machine is also complicated that the price is much higher than what the average person can afford. Therefore, an economic drying appliance that is affordable to the public while its safety properties conform to the national standards is a demand in the market. The Chinese Patent Number 03267656.5 discloses a dryer using a dual-layered wall structure with a relatively cheap cost and ironing free feature. Yet it still has the following disadvantages. The steam rises from the clothes during drying can only exit from the vent located at the bottom of the dryer that violates the scientific theory. In addition, it slows down the drying speed, adversely affects the drying ability and is energy consuming. There is no way to control the conditions including the temperature and humidity inside the dryer. If the hanging large clothes after dried falls by accident and blocks the exit vent, damages to the clothes and safety hazard may occur.

SUMMARY OF THE PRESENT INVENTION

An object of the present invention is to provide a cabinet-type clothes drying appliance which overcomes the above-mentioned problems of the conventional dryers: i.e. the poor efficiency, slow speed, lacking of temperature and humid control, and safety hazard.

Accordingly, in order to accomplish the above objects, the present invention provides a cabinet-type clothes drying appliance which comprises a base, a frame, a cover, and a control unit. It further comprises a heat source is used for making hot air and high pressure, a warm air cushioning chamber used for mixing high and low temperature air, and a clothes drying chamber used for drying the clothes within the drying chamber.

The heat source comprises a wind turbine and a PTC heating element, wherein the base comprises the heat source and a warm air channel. The frame is provided at an upper portion of the base and supported by a hanger pole, wherein the hanger pole comprises a division plate for the warm air cushioning chamber and a top net plate. A lower portion of the division plate for the warm air cushioning chamber and the protection plate of the warm air channel define the warm air cushioning chamber and an upper portion of the division plate for the warm air cushioning chamber and the top net plate 11 define the cloth drying chamber. At least a hanging pole is provided at the upper portion of the clothes drying chamber. The cover, which is made of high temperature resistant and airtight material, concealedly covers the frame and one or more exhaust holes are provided on top of the cover. The control unit comprises a control panel and switches. The control unit further comprises a main control having a humidity sensor and a temperature sensor, wherein the temperature sensor is provided at the division plate for the warm air cushioning chamber in the drying chamber, the warm air cushioning chamber or the protection plates of the warm air channel, wherein the humid sensor is provided at the warm air cushioning chamber and the drying chamber.

In order to purify the air exiting from the PTC outlet, an ultraviolet ray sterilizer can be mounted on one side of the PTC outlet. Furthermore, in order to prevent people from being hurt by the ultraviolet ray produced by ultraviolet ray light, the light cap is provided on the upper portion of the ultraviolet ray light.

The hanger pole having a fastener is provided at the four corners of the base for supporting the base. The division plate for the warm air cushioning chamber and the top net plate are provided from top to bottom of the hanger pole respectively through the connecting block, wherein the division plate for the warm air cushioning chamber forms the warm air cushioning chamber with the protection plate of the warm air channel in the lower parts and forms the cloth drying chamber, and the distance between each of them is larger than 60 cm so as to guarantee the temperature of the air coming out from the hot air channel is fully decreased.

The effect of the present invention is that the steam rising from the bottom of the base is scientifically going up following the natural rule: the hot air is usually going up. That is it shows the innovation structure to overcome the conventional problems in conventional technology and provide a safe, faster way to dry clothes. Furthermore, the procedure of drying cloth is controllable. In order to prevent energy waste, the bottom portion of the cover and the upper portion of the base are sealed together to achieve the goal of energy saving. On the other hand, a couple of small holes are provided at the upper portion of the cover as an output of the steam from bottom to top for improving the clothes drying efficiency. The temperature and humidity within the warm air cushioning chamber are measured by temperature sensor and humid sensor, and response the result for the main control such that the clothes drying appliance is capable of automatically turning off the power while the temperature of the clothes drying appliance is not normal or the cloth is dry enough to achieve the goal of energy saving. The efficiency of drying cloth is high, and the drying speed is fast. Furthermore, safe is guaranteed while hanging clothes fall down.

These and other objectives, features, and advantages of the present invention will become apparent from the following detailed description, the accompanying drawings, and the appended claims.

Figure 1:
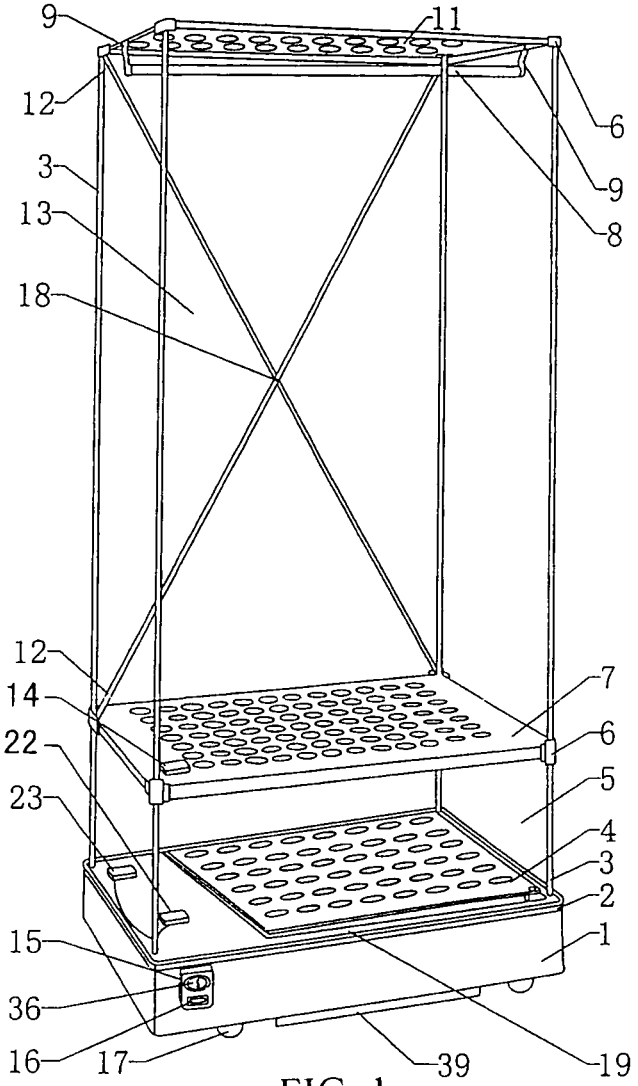
FIG. 1 is an inner structural drawing of a cabinet-type clothes drying appliance according to a preferred embodiment of the present invention.
Figure 2:
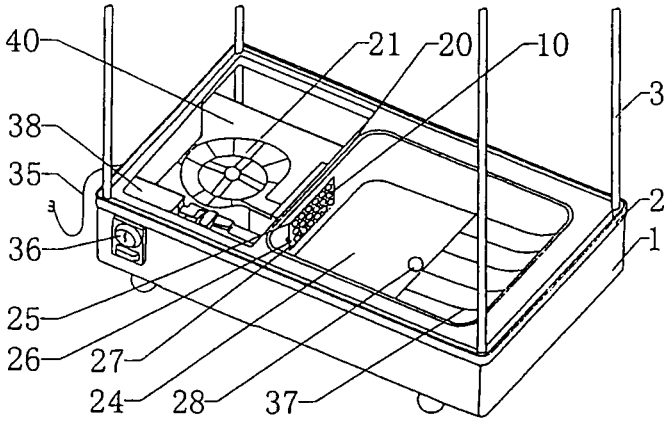
FIG. 2 is a structural drawing of the base of the clothes drying appliance according to the preferred embodiment of the present invention.
Figure 3:
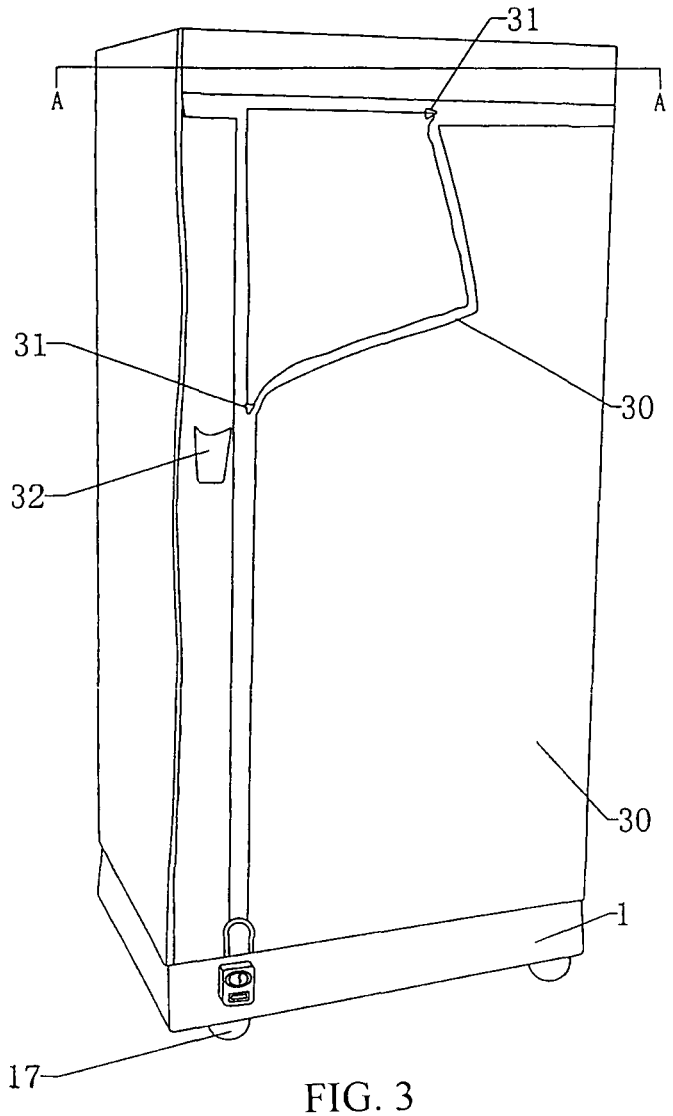
FIG. 3 is a perspective view of the clothes drying appliance according to the preferred embodiment of the present invention.
Figure 4:
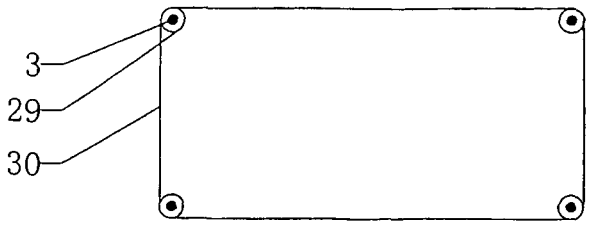
FIG. 4 is an A-A sectional view of FIG. 3.
Figure 5:
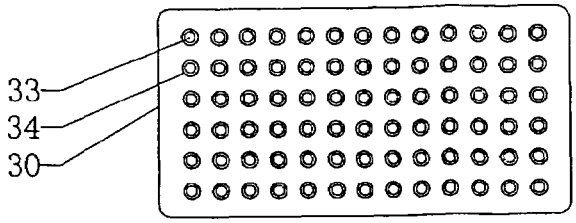
FIG. 5 is a top view of the clothes drying appliance according to the preferred embodiment of the present invention.

In the drawing: 1. Base; 2. protruding stand; 3. hanger pole; 4. protection plates of the warm air channel; 5. warm air cushioning chamber; 6. connecting block; 7. division plate for the warm air cushioning chamber; 8. hanging poles; 9. connector of hanging poles; 10. PTC heating element; 11. top net plate; 12. anti-lateral X shaped connection pole; 13. clothes drying chamber; 14. humidity sensor; 15. control panel; 16. storage of remote control; 17. Caster; 18. Pivot; 19. waterproof stand; 20. division plate; 21. wind turbine; 22. temperature sensor; 23. ozone sterilizer; 24. hot wind channel; 25. PTC outlet; 26. ultraviolet ray sterilizer; 27. PTC filter net; 28. water outlet; 29. Fastener; 30. cover; 31. slide fastener; 32. Pocket; 33. air outlet; 34. ring shape metal mounting piece; 35. power line; 36. control unit switch; 37. arch-shaped wall; 38. main control; 39. water box; 40. dustproof net.

DETAILED DESCRIPTION OF THE PREFERRED EMBODIMENT

Referring to FIGS. 1 to 5 of the drawing, a cabinet-type clothes drying appliance according to a preferred embodiment of the present invention is illustrated, which comprises a base 1, a moveable wheels 17 providing at the base 1, a frame, a cover 30, and a control unit, wherein a protruding stand 2 is provided at a boundary of the base for fastening the cover 30 along a lower opening thereof. The base 1 further comprises a humidity sensor 14 and an ozone sterilizer 23. A waterproof stand 19 is provided at the boundary of the base 1. A front side of the base 1 provides a control unit switch 36, a humidity sensor 15 and a storage of remote control 16. Also, a main control 38 and a wind turbine 22 are provided at one side of the base 1 to form a heat source, and that a hot wind channel 24 having a water outlet 28 is provided at another side of the base 1. A divisional plate 20 is provided between two sides of the base 1. A hot wind channel 24 comprises a protection plate of the warm air channel 4 at an upper portion of the hot wind channel 24, and that an arch-shape wall 37 is provided at the end of the hot wind channel 24, wherein when the hot air is guided to touch to the arch-shaped wall 37, the hot air is favorable guided to the warm air cushioning chamber 5. Moreover, an air inlet with a dustproof net 40 is provided at a bottom portion of the heat source, wherein a PTC filter net 27 is provided at a PTC outlet 25 for communicating with the hot wind channel 24 while a PTC heating element 10 is mounted between them, wherein the cross section of the connection part between the hot wind channel 24 and the PTC heating element 10 is 1.1 times larger than that of the real cross section area of the PTC outlet. The length of the PTC heating element 10 is 1.2 times larger than that of the real length of the PTC heating element 10.

In order to purify the air exiting from the PTC outlet 25, an ultraviolet ray sterilizer 26 is mounted on one side of the PTC outlet 25. Furthermore, in order to prevent people from being hurt by the ultraviolet ray produced by the ultraviolet ray sterilizer 26, a light cap is provided on an upper portion of the ultraviolet ray sterilizer 26.

The hanger pole 3 having a fastener 29 is provided at four corners of the base 1 for supporting the base. The division plate for the warm air cushioning chamber 7 and a top net plate 11 are provided from top to bottom of the hanger pole 3 respectively through the connecting block 6, wherein a lower portion of the division plate for the warm air cushioning chamber 7 and the protection plate of the warm air channel 4 define the warm air cushioning chamber 5 while the distance therebetween is larger than 60 cm so as to guarantee the temperature of the air coming out from the hot air channel 24 is fully decreased. An upper portion of the division plate for the warm air cushioning chamber 7 and the top net plate 11 define the clothes drying chamber 13. At least a hanging pole 8 connecting to the top net plate 11 through the connector of hanging poles is provided at the upper portion of the clothes drying chamber 13. In order to make the frame remaining in a straight manner, an anti-lateral X shaped connection pole 12 is provided on a back side of the hanger pole 3 and affixed by a pivot 18. Otherwise, a soft wire is another alternative way to achieve the same goal. The humidity sensor 14 is provided in the warm air cushioning chamber 5 or the clothes drying chamber 13.

The cover 30, which is made of high temperature resistant and airtight material, concealedly covers the frame. A slide fastener 31 and a pocket 32 are provided on a front side of the cover 30 which comprises a plurality of exhaust holes 33 on its top, each having a size between 5 to 20 mm. A boundary of each of the exhaust holes is affixed by a ring shape metal mounting piece 34. Moreover, to position the cover 3, tighten the elastic wire at the protruding stand 2 and the lower portion of the cover 30 and affix the fastener 29 between the cover 30 and the hanger pole 3. The control unit comprises a control panel 15 and a main control 38. The control unit comprises a main control 38 having a humidity sensor 14 and a temperature sensor 22 and a switch 36, wherein the temperature sensor 22 is provided at the division plate for the warm air cushioning chamber 7 in the drying chamber 3, the warm air cushioning chamber 5 or the protection plates of the warm air channel 4.

Figure 6:
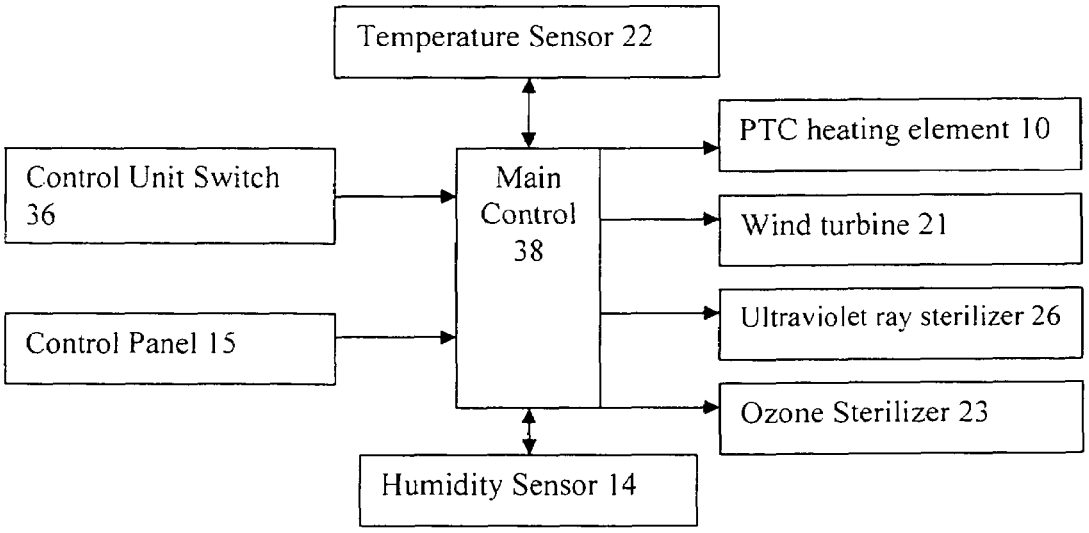
FIG. 6 is a block diagram illustrating an operation of the present invention.

The control unit is illustrated in FIG. 6; in the beginning, connecting to the power source and opening the control unit switch 36, and the control panel 15. After the connection is on, the main control 38 starts to send signals to the wind turbine 21, the PTC heating element 10, the ozone sterilizer 23, and the ultraviolet ray sterilizer 26 and make all of them start working. Meanwhile, the temperature sensor 22 and the humidity sensor 14 start to detect the temperature and humidity in the warm air cushioning chamber 5 and the clothes drying chamber 13 and transform the information to the main control 38. When the temperature detection is over the critical value, the main controller 38 sends a signal to the PTC heating element 10 to stop its heating procedure such that the temperature of the warm air cushioning chamber 5 will drop down because of heat exchange. On the contrary, when the temperature detection is down to the low critical temperature, the main control 38 sends another signal to activate the PCT heating element. When the humidity of the clothes drying chamber 13 is down to a preset value, the main controller 38 sends a signal to the PTC heating element 10 to stop its heating procedure. Finally, when the temperature of the warm air cushioning chamber 5 is down to the preset value, the main control sends signals to the wind turbine 21, the ozone sterilizer 23, and the ultraviolet ray sterilizer 26 to stop working and sends a done drying signal.

During operation, the cover 30 can be opened through the slide fastener 31 for the wet clothes to be hanged on the hanging poles 8. Then close the slide fastener 31 and activate the power line 35 with the power source. Switch on the control unit switch 36 and the control panel 15, the main control 38 sends signal to activate the wind turbine 21, the PTC heating element 10, the ultraviolet ray sterilizer 26, and the ozone sterilizer 23 working, in order to suck in room temperature purified air filtered by the dustproof 40 which is further heated and sent to the hot wind channel 24. After that, the purified air is sterilized by the ultraviolet ray sterilizer 26 and discharged through the protection plates of the warm air channel 4 into the warm air cushioning chamber 5 for a heat exchange with the cooling air originally existed here, such that the air temperature is going down. After that, the temperature of the air is keep going up after the air is further sterilized through the ultraviolet ray sterilizer 26. The air temperature will stop going up until the air in the clothes drying chamber 13 is dry enough for drying the wet clothes.

Meanwhile, the temperature of the steam in the clothes drying chamber 13 increases due to hot air therein while the density of the steam reduces. Because of the blowing effect of the wind turbine 21 and the airtight cover 30, the wet air quickly rises to discharge through the air outlet 33 at the top portion of the cover 30. Meanwhile, the water dripped from the clothes flows into the water outlet 28 of the hot wind channel 24 through the division plate for the warm air cushioning chamber 7 and flows into the water box 39. Because the bottom of the hot wind channel 24 is at least 5 mm lower than the bottom of PTC heating element 10, the water from the wet clothes will not flow to the wind turbine 21.

In the drying process, the water in the wet clothes is gradually decreased until the clothes are totally dry. If the clothes have become dry or the hanging clothes falls down to block the hole on the warm air cushioning chamber 5, the room temperature of the warm air cushioning chamber 5 rises to high critical value and a response message will be sent by temperature sensor 22 to the main control 38. The main control 38 sends a signal to the PTC heating element 10 to stop working for saving energy. On the contrary, when the humidity of the clothes drying chamber 13 is going down to the preset value, the main control 38 send a signal to the PTC heating element 10 to stop working. Finally, when the temperature of the warm air cushioning chamber 5 is going down to the preset value, the main control 38 sends signals to the wind turbine 21, the ozone sterilizer 23 and the ultraviolet ray sterilizer 27 to stop working. After power off the cabinet-type clothes drying appliance and disconnect the power source, the slide fastener can be opened to pick the clothes out.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A clothes drying appliance, comprising:

a base which comprises a division plate to divide said base into a first side and an opposed second side;

a heat source provided at said first side of said base and a hot wind channel at said second side of said base, wherein said heat source has an air inlet and comprises a wind turbine and a PTC heating element having a PTC outlet for heating up a flow of air from said air inlet and for generating a flow of hot air at said PTC outlet toward said hot wind channel, wherein said hot wind channel has a water outlet at a bottom of said hot wind channel and an arch-shaped wall at an end of said hot wind channel, wherein said water outlet is formed at said bottom of said hot wind channel between said heat source and said arch-shaped wall, wherein said arch-shaped wall is extended from said bottom of said hot wind channel, such that said hot air is guided to flow along said bottom of said hot wind channel toward said arch-shaped wall, wherein said bottom of said hot wind channel is positioned below said PTC heating element, such that said water outlet is positioned below said PTC heating element;

a frame provided on said base, wherein said frame comprises a warm air division plate, a protection plate, and a top net plate, wherein said protection plate is positioned on said base to define said hot wind channel below said protection plate, wherein a warm air cushioning chamber is formed between said protection plate and said warm air division plate, wherein a clothes drying chamber is formed between said division plate and said top net plate, wherein said arch-shaped wall guides said hot air from said hot air channel along said bottom side thereof until said hot air hits said arch-shaped wall to said warm air cushioning chamber through said protection plate in order to initially mix with cool air within said warm air cushioning chamber for initially reducing a temperature of said hot air within said warm air cushioning chamber, wherein the temperature within said warm air cushioning chamber is then gradually increased;

a cover covering said frame to conceal said warm air cushioning chamber and said clothes drying chamber, wherein at least an exhaust hole is provided on a top side of said cover for discharging wet air from said clothes drying chamber; and a control unit which comprises a humidity sensor provided at said warm air division plate within said clothes drying chamber and a temperature sensor supported within said warm air cushioning chamber, wherein said humidity sensor detects humidity in said clothes drying chamber that when said humidity is below a preset humidity value, said PTC heating element is deactivated to generate heat, wherein said temperature sensor detects temperature within said warm air cushioning chamber that when said temperature is higher than a preset temperature value, said PTC heating element is deactivated to generate heat.

2. The clothes drying appliance, as recited in claim 1, wherein said bottom of said hot wind channel is positioned at least 5 mm below a bottom of said PTC heating element for preventing water at said hot wind channel flowing to said heat source.

3. The clothes drying appliance, as recited in claim 2, wherein a distance between said protection plate and said warm air division plate must be larger than 60 cm for ensuring the temperature of said hot air being fully decreased within said warm air cushioning chamber.

4. The clothes drying appliance, as recited in claim 3, wherein said frame further comprises at least a hanging pole is provided on a top portion of said clothes drying chamber, a hanger pole supporting said cover, and an anti-lateral X shaped connection pole provided on a back side of said hanger pole and fixed by a pivot.

5. The clothes drying appliance, as recited in claim 4, further comprising an ozone sterilizer, an ultraviolet ray sterilizer provided at a said PTC outlet of said PTC heating element, and a dustproof net provided at said air inlet of said heat source.

6. The clothes drying appliance, as recited in claim 5, further comprising a protruding stand provided at a boundary of said base for fasten said cover, and a waterproof stand provided at the boundary of said base.

* * * * *